US009219970B2

(12) United States Patent
Bae et al.

(10) Patent No.: US 9,219,970 B2
(45) Date of Patent: Dec. 22, 2015

(54) METHOD AND APPARATUS FOR MANUFACTURING A PASSIVE COMPONENT FOR AN ACOUSTIC TRANSDUCER

(75) Inventors: Byungkuk Bae, Daegu (KR); Yongrae Roh, Daegu (KR); Hoseop Shin, Gumi-si (KR)

(73) Assignee: ALPINION MEDICAL SYSTEMS CO., LTD. (KR)

( * ) Notice: Subject to any disclaimer, the term of this patent is extended or adjusted under 35 U.S.C. 154(b) by 359 days.

(21) Appl. No.: 13/502,929

(22) PCT Filed: Oct. 14, 2010

(86) PCT No.: PCT/KR2010/007020
§ 371 (c)(1),
(2), (4) Date: Apr. 19, 2012

(87) PCT Pub. No.: WO2011/049319
PCT Pub. Date: Apr. 28, 2011

(65) Prior Publication Data

US 2012/0204416 A1 Aug. 16, 2012

(30) Foreign Application Priority Data

Oct. 20, 2009 (KR) ..... 10-2009-0099939

(51) Int. Cl.
*B06B 1/00* (2006.01)
*H04R 31/00* (2006.01)

(52) U.S. Cl.
CPC ..... *H04R 31/00* (2013.01); *Y10T 29/49005* (2015.01)

(58) Field of Classification Search
CPC ..... B06B 1/00; B06B 3/00; B06B 2201/70
USPC ..... 264/442
See application file for complete search history.

(56) References Cited

U.S. PATENT DOCUMENTS 5,451,362 A * 9/1995 Wombwell et al. ..... 264/328.6
6,103,784 A * 8/2000 Hilborn et al. ..... 523/219
2009/0273070 A1 11/2009 Tendou et al.

FOREIGN PATENT DOCUMENTS

JP 2007066587 A 3/2007
JP 2008143105 A 6/2008

(Continued)

OTHER PUBLICATIONS

Bittmann et al. "Ultrasonic dispersion of inorganic nanoparticles in epoxy resin", Ultrasonics: Sonochemistry, Butterworth-Heinemann, GB, vol. 16, No. 5, Jun. 1, 2009, pp. 622-628.*

(Continued)

*Primary Examiner* — Christina Johnson
*Assistant Examiner* — Xue Liu
(74) *Attorney, Agent, or Firm* — Harness, Dickey & Pierce, P.L.C.

(57) ABSTRACT

The present disclosure relates to a method and apparatus for manufacturing a passive component for an acoustic transducer, wherein a mixture of metal oxide filler with an epoxy resin is subjected to ultrasonic wave generated and followed by an addition of a hardener to cast the passive component for the acoustic transducer. Mixing the materials with the ultrasonic wave improves the dispersion of the metal oxide filler over conventional passive components, thus enabling the passive component to have uniform surfaces, resulting in improved sound velocity and attenuation characteristics with acoustic transducers that use the passive component manufactured by the present disclosure.

6 Claims, 5 Drawing Sheets

(56) References Cited

FOREIGN PATENT DOCUMENTS

| | | | |
|---|---|---|---|
| KR | 102008007887 | A | 8/2008 |
| KR | 1020080100035 | A | 11/2008 |

OTHER PUBLICATIONS

International Search Report in Korean (with English Translation) for PCT/KR2010/007020, mailed Jul. 20, 2011; ISA/KR.

* cited by examiner (a)

(b)

(a)

(b)

METHOD AND APPARATUS FOR MANUFACTURING A PASSIVE COMPONENT FOR AN ACOUSTIC TRANSDUCER

TECHNICAL FIELD

The present disclosure relates to a method and apparatus for manufacturing a passive component for an acoustic transducer.

BACKGROUND

The statements in this section merely provide background information related to the present disclosure and may not constitute prior art.

Passive components for use in an acoustic transducer are manufactured by adding metal oxide filler to unprocessed epoxy resins.

In the process of making the passive components as illustrated in FIG. 1, the epoxy resins, a hardener, and the filler are measured and mixed well by hands first and then with a machine to a sufficient degree.

Then, the mixture is casted after first removing gas generated while mixing the epoxy resin, hardener, and filler followed by a secondary removal of gas, curing, cutting out and finishing casted passive components into final passive component products.

It is important in this process of manufacturing the passive components to have a proper dispersion of the metal oxide filler added to the unprocessed epoxy resins. An improper or incomplete dispersion causes agglomeration in powders of the epoxy resin having the metal oxide filler added, and thus causes failure in the uniformity of the resultant passive components.

Possible causes of the powder agglomeration include tendency of the powder particles to reach a stable state from relatively high surface energy over their surfaces through mutual aggregation; inter-particle Van der Waals force stronger than the particle's own gravity; or other causes such as hydrogen bonding on the surface, moisture absorption and chemical bonding, etc.

Storing the material in a desiccator capable of adjusting humidity may help to avoid the adsorption by moisture to some extent, since a complete prevention of the aggregation of material in the dry state is difficult to achieve.

There is, however, still difficulty of completely preventing the inter-particle aggregation of the powders even by such method of storing the material in the desiccator, and as well as a hassle to keep the powders in the desiccator.

DISCLOSURE

Technical Problem

To solve the above-mentioned problem, it is an object of the present disclosure to provide a method and apparatus for manufacturing a passive component for an acoustic transducer, which can minimize the agglomeration between particles in power forms of material.

Summary

An embodiment of the present disclosure provides a method for manufacturing a passive component for an acoustic transducer, including: making a first mix by mixing a metal oxide filler with an epoxy resin; generating any applying ultrasonic wave towards the first mix in order to disperse the metal oxide filler included in the first mix; making a second mix by adding a hardener to the first mix processed with the ultrasonic wave; and making a casting with the second mix.

The process of making the second mix further comprises removing gas from the second mix with the hardener added, and the process of making the casting uses the second mix with the gas removed to make the casting.

The process of making the casting further comprises removing gas from the casting.

Another embodiment of the present disclosure provides an apparatus for manufacturing a passive component for an acoustic transducer, including: a mixer for making a material mix by mixing a metal oxide filler with an epoxy resin; and an ultrasonic wave generator located adjacent to the mixer for generating and applying ultrasonic wave towards the mixer.

In addition, a space for filling a material is formed between the mixer and the ultrasonic wave generator.

The material is preferably liquid.

Advantageous Effects

According to the present disclosure as described above, the passive component manufactured from mixing materials by applying ultrasonic wave presents a superior dispersion of the metal oxide filler, which results in a uniform surface and accordingly improved sound velocity and attenuation characteristics in acoustic transducers that employ the passive component manufactured in the inventive method.

DETAILED DESCRIPTION

Hereinafter, an aspect of the present disclosure will be described in detail with reference to the accompanying drawings, but known technical details will be omitted or abridged for the simplicity of descriptions.

<Apparatus>

Figure 1:
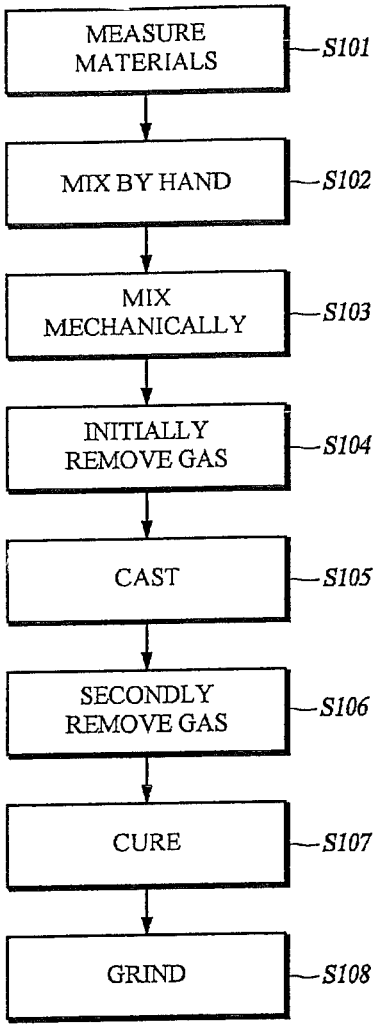
FIG. 1 Prior Art
FIG. 1 is a flow diagram for a prior art method of manufacturing a passive component for an acoustic transducer.
Figure 2:
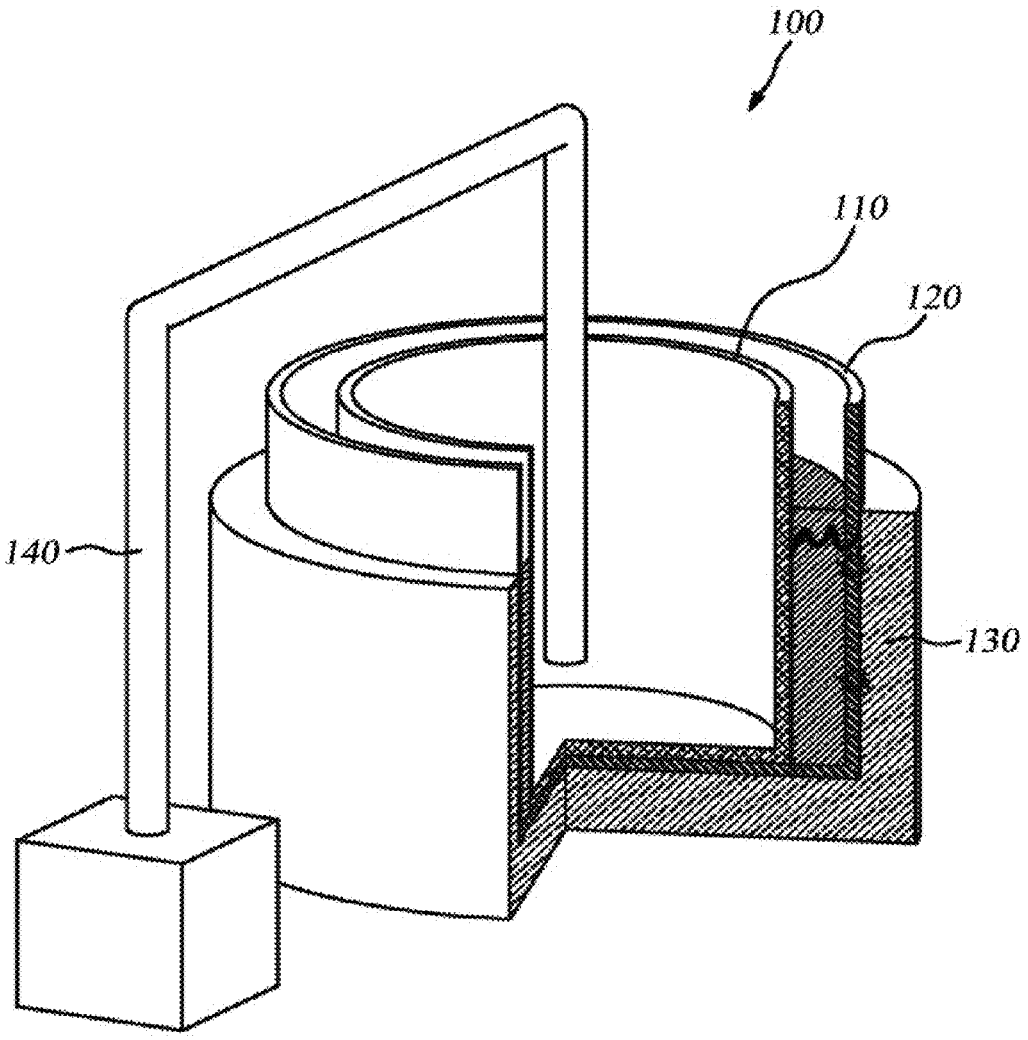
FIG. 2 is a schematic diagram showing an apparatus for manufacturing a passive component for an acoustic transducer according to the present disclosure.

An apparatus 100 for manufacturing a passive component for an acoustic transducer according to the present disclosure comprises a mixing container 110, a liquid reservoir 120, an ultrasonic chamber 130, and a mechanical mixer 140, as shown in FIG. 2.

Mixing container 110 is adapted to mix therein measured amounts of an epoxy resin, metal oxide filler and hardener in this aspect of the present disclosure.

Liquid reservoir 120 is for containing a liquid as a medium for transmitting ultrasonic wave to mixing container 110, and is located in between mixing container 110 and ultrasonic chamber 130 in a structure for containing and enveloping the mixing container 110.

To generate the ultrasonic wave, ultrasonic chamber 130 is located outside of liquid reservoir 120 and supplies the ultrasonic wave to liquid reservoir 120.

In this exemplary configuration, mixing container 110, liquid reservoir 120, and ultrasonic chamber 130 are formed as a single body.

Mechanical mixer 140 is for mechanically mixing the materials in mixing container 110. The main body of mechanical mixer 140 is installed outside mixing container 110 but its arm extends to the interior of mixing container 110.

<Method>

Figure 3:
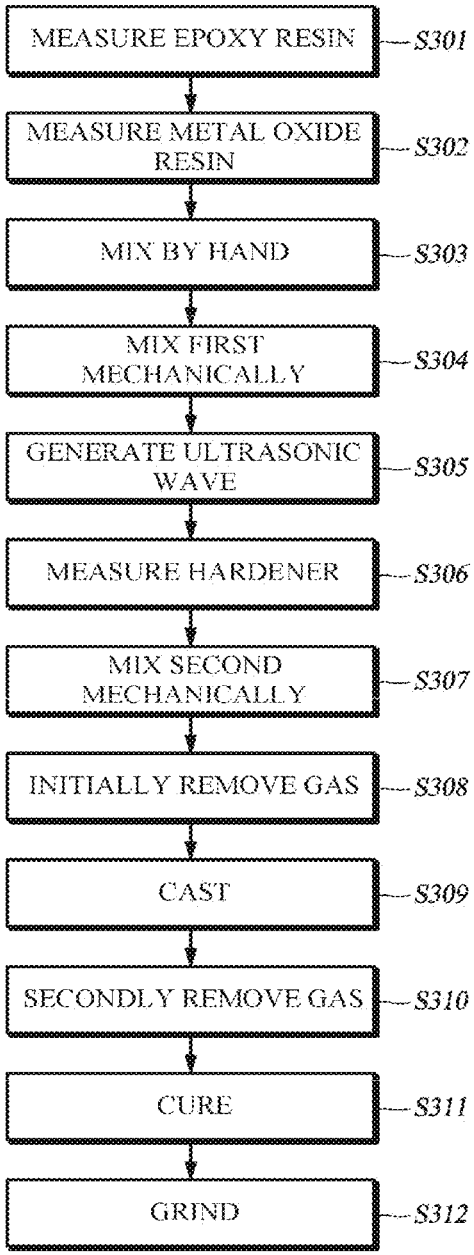
FIG. 3 is a flow diagram for a method for manufacturing a passive component for an acoustic transducer according to the present disclosure.
Figure 4:
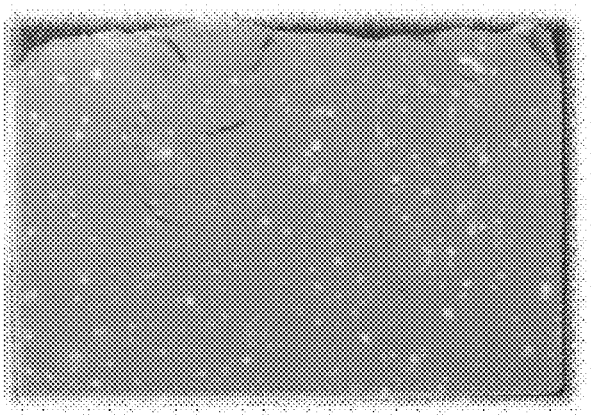
FIG. 4 is (a) picture taken for a surface inspection of a passive component made by a prior art method, and (b) picture taken for a surface inspection of a passive component made by the present disclosure.
Figure 4:
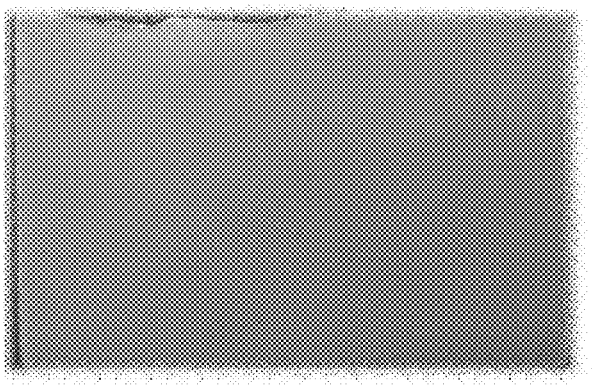
Figure 5:
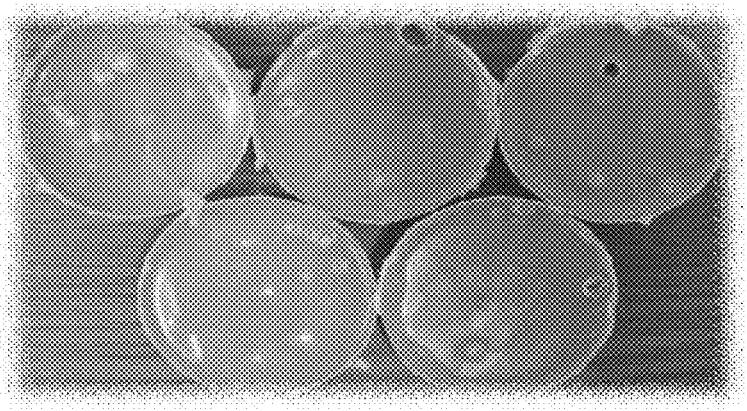
FIG. 5 is (a) picture of a passive component made by a prior art method, and (b) picture of a passive component made by the present disclosure.
Figure 5:
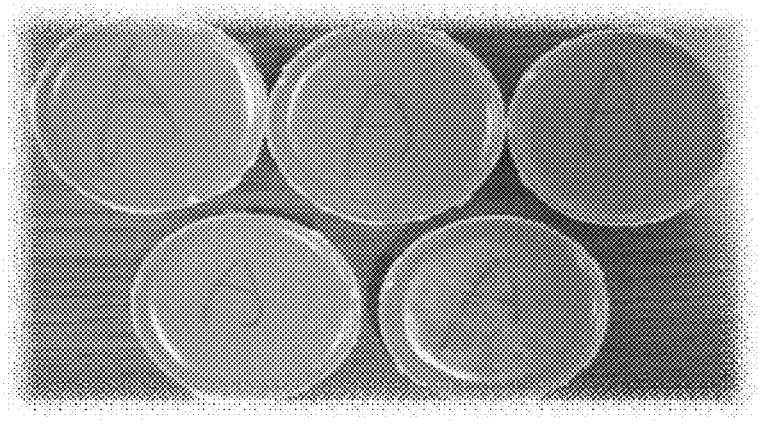

Description will be provided as to a method for manufacturing a passive component using apparatus 100 according to the present disclosure with reference to a flow diagram of FIG. 3 and further to FIGS. 4 and 5 where necessary.

First, amount as measured by weight for the main ingredients of the passive components for the acoustic transducer such as powder form of the epoxy resin is put into mixing container 110 at step S301.

At step S302, measured amount of a metal oxide is put into mixing container 110 with the epoxy resin placed at step S301. Thus, a first mix is to be made in mixing container 110 by mixing the metal oxide filler with the epoxy resin.

At step S303, mixing for the first mix of the epoxy resin with the metal oxide filler is carried out by hand for dispersing the metal oxide filler throughout the epoxy resin.

Step S304 reruns the hand-mixed first mix from step S303 by using a first mechanical mixing. Thus, the secondary mixture by machine combined with the initial mixture at step S303 facilitates a proper dispersion of the metal oxide filler over the epoxy resin.

Following the mechanical mixing at step S304, ultrasonic wave generated by ultrasonic chamber 130 is applied in further mixing of the first mix contained in mixing container 110 at step S305, wherein the ultrasonic vibrations help to evenly disperse the epoxy resin and metal oxide filler in powder forms or even in agglomeration state.

In other words, if the particles of the metal oxide filler or epoxy resin are in partial agglomeration, the aggregated particles may not have become properly dispersed through steps S303 and S304, whereas the ultrasonic wave at step S305 can vibrate even the particle agglomeration off into a uniform dispersion.

At step S306, a measured hardener is added to mixing container 110 for hardening the first mix with the epoxy resin and metal oxide filler in mixture from S305. This produces a second mix which contains the epoxy resin, metal oxide filler and hardener.

Step S307 performs a second mechanical mixing of the second mix containing the first mix with the hardener included at step S306.

During the mixing operation at step S307 to produce the second mix, the mechanical mixing generates gas in such form as air bubbles inside of the mix and the gas is removed at step S308. With this necessary process of gas removal, the final passive component products can be made more uniform.

Casting is performed at step S309 by pouring the second mix into a mold for shaping it.

Gas is secondly removed at step S310 from the casting formed at step S309.

The casting from which gas has been removed at step S310 is cured at step S311, and at step S312 the casting cured at step S311 is ground into a form ready for use in an acoustic transducer.

The passive component shown in FIG. 4 was made by providing unprocessed epoxy resins with an additive of a metal oxide filler of ZnO with a mean density of 100 um. In this event, picture (a) represents a conventional method of production, and picture (b) is manufactured with the ultrasonic wave processing of the present method. Surface inspections of the two by comparison from picture (b) of FIG. 4 according to the present disclosure confirm the accomplished uniformity of the metal oxide filler over the conventional counterpart.

Further, an experiment with the passive component with ZnO added to the epoxy resin product by the present method of manufacture is shown in Table 1.

TABLE 1

| | Acoustic properties | | | | |
|---|---|---|---|---|---|
| PASSIVE COMPONENT | Longitudinal Velocity (m/s) | Shear Velocity (m/s) | Longitudinal Attenuation (dB/mm) | Shear Attenuation (dB/mm) | Impedance (Mrayls) |
| PRIOR ART | 2,473.33 | 1,125.00 | 0.96 | 5.92 | 3.58 |
| PRESENT DISCLOSURE | 2,505.33 | 1,134.00 | 0.79 | 5.36 | 3.63 |

Reviewing the above result, it can be confirmed that the passive component manufactured by the present method has improved longitudinal velocity and shear velocity compared to those of the prior art. Attenuation phenomena are also decreased to attain improved characteristics of the component. In addition, impedance of the passive component is shown improved according to the present disclosure.

In addition, a passive component shown in FIG. 5 was made by providing unprocessed epoxy resins with an additive of a metal oxide filler of $Al_2O_3$ with a mean density of 5 um. In FIG. 5, picture (b) is the production with the ultrasonic wave processing of the present method. An inspection from picture (b) of FIG. 5 according to the present disclosure confirms not only the improved uniformity of the metal oxide filler but also a reduced viscosity of the epoxy resins.

Further, an experiment with the passive component with $Al_2O_3$ added to the epoxy resin product by the present method of manufacture is shown in Tables 2 and 3.

TABLE 2

| PASSIVE COMPONENT | Sample No. | Density ($10^3$ kg/m$^3$) | Longitudinal Velocity (m/s) | Shear Velocity (m/s) |
|---|---|---|---|---|
| PRIOR ART | 1 | 2.164 | 2907.00 | 1598.00 |
| | 2 | 2.174 | 2915.00 | 1601.00 |
| | 3 | 2.171 | 2945.00 | 1600.00 |
| | 4 | 2.169 | 2902.00 | 1596.00 |
| | 5 | 2.165 | 2950.00 | 1599.00 |
| | Average | 2.169 | 2923.80 | 1598.80 |
| PRESENT DISCLOSURE | 1 | 2.186 | 2944.00 | 1606.00 |
| | 2 | 2.188 | 2945.00 | 1600.00 |
| | 3 | 2.185 | 2934.00 | 1598.00 |
| | 4 | 2.188 | 2943.00 | 1600.00 |
| | 5 | 2.185 | 2946.00 | 1600.00 |
| | Average | 2.186 | 2942.40 | 1600.80 |

TABLE 3

| PASSIVE COMPONENT | Sample No. | Longitudinal Attenuation (dB/mm) | Shear Attenuation (dB/mm) | Longitudinal Impedance (Mrayls) | Shear Impedance (Mrayls) |
|---|---|---|---|---|---|
| PRIOR ART | 1 | 1.11 | 2.58 | 6.29 | 3.46 |
| | 2 | 1.16 | 2.60 | 6.34 | 3.48 |
| | 3 | 1.05 | 2.52 | 6.39 | 3.47 |
| | 4 | 0.97 | 2.42 | 6.29 | 3.46 |
| | 5 | 1.12 | 2.40 | 6.39 | 3.46 |
| | Average | 1.08 | 2.50 | 6.34 | 3.47 |
| PRESENT DISCLOSURE | 1 | 0.74 | 2.23 | 6.44 | 3.51 |
| | 2 | 0.73 | 2.19 | 6.44 | 3.50 |
| | 3 | 0.75 | 2.21 | 6.41 | 3.49 |
| | 4 | 0.74 | 2.18 | 6.44 | 3.50 |
| | 5 | 0.74 | 2.19 | 6.44 | 3.50 |
| | Average | 0.01 | 2.20 | 6.43 | 3.50 |

The above results show that the passive component manufactured by the present method exhibits a density which is closer to the theoretical density of $2.192^{10^3 kg/m^3}$ for the epoxy resin and $Al_2O_3$. Herein, the theoretical densities of the epoxy resin and $Al_2O_3$ are calculated by formula 1.

$$\frac{100-66.5}{1.18}+\frac{66.5}{3.86}=\frac{100}{D},\ \therefore D=2.192 \qquad \text{Formula 1}$$

In this case, the density of the epoxy resin is 3.86, and $Al_2O_3$ is 1.18 by density and 66.5% by weight (wt %).

Further, it is clear that the sound velocity and attenuation characteristics of the epoxy resin and $Al_2O_3$ are compared with the conventional counterparts.

Furthermore, manufacturing the passive components for an acoustic transducer using ultrasonic wave processing obviates the need for safekeeping the powder state of the epoxy resins and metal oxide filler in the desiccators against harmful agglomerations, which is definitely advantageous. This is thanks to the ultrasonic wave process applicable to the possible particle agglomerations formed during the storage of the materials by dispersing them back to the original dispersed state.

Although exemplary embodiments of the present disclosure have been described with reference to the drawings attached for illustrative purposes, those skilled in the art will appreciate that various modifications, additions and substitutions are possible, without departing from essential characteristics of the disclosure. Therefore, exemplary aspects of the present disclosure should not be understood in a sense limited to the embodiments but by the claims in the following and the equivalents thereof.

CROSS-REFERENCE TO RELATED APPLICATION

If applicable, this application claims priority under 35 U.S.C §119(a) of Patent Application No. 10-2009-0099939, filed on Oct. 20, 2009 in Korea, the entire content of which is incorporated herein by reference. In addition, this non-provisional application claims priority in countries, other than the U.S., with the same reason based on the Korean Patent Application, the entire content of which is hereby incorporated by reference.

The invention claimed is:

1. An apparatus for preparing a material mix for casting a passive component for an acoustic transducer, comprising:

a mixer which is a centrally located container;

an ultrasonic wave generator which surrounds but is spaced from the mixer; and a liquid reservoir which is located between the container and ultrasonic wave generator, wherein the mixer makes a first material mix by mixing a metal oxide filler with an epoxy resin, and the ultrasonic wave generator located adjacent to the mixer generates and applies ultrasonic waves towards the mixer to disperse the metal oxide filler in the first material mix, and wherein the mixer makes a second material mix by adding a hardener to the first material mix processed with the ultrasonic wave by using the ultrasonic wave generator, and wherein the first and the second material mix are used to manufacture the passive component for the acoustic transducer.

2. The apparatus of claim 1, wherein a space for filling a material is formed between the mixer and the ultrasonic wave generator.

3. The apparatus of claim 2, wherein the material is liquid.

4. A method for manufacturing a passive component for an acoustic transducer, comprising:

making a first material mix by mixing a metal oxide filler with an epoxy resin;

generating and applying ultrasonic waves towards the first material mix to disperse the metal oxide filler included in the first material mix;

making a second material mix by adding a hardener to the first material mix processed with the ultrasonic waves; and making the casting with the second material mix to manufacture the passive component for the acoustic transducer, wherein the method for manufacturing the passive component for the acoustic transducer is performed by an apparatus including a mixer which is a centrally located container; an ultrasonic wave generator which surrounds but is spaced from the mixer; and a liquid reservoir which is located between the container and the ultrasonic wave generator, and wherein the mixer makes the first material mix by mixing the metal oxide filler with the epoxy resin, and the ultrasonic wave generator located adjacent to the mixer generates and applies ultrasonic waves towards the mixer to disperse the metal oxide filler in the first material mix, and wherein the mixer makes the second material mix by adding the hardener to the first material mix processed with the ultrasonic waves by using the ultrasonic wave generator.

5. The method of claim 4, which further comprises:

removing gas from the second material mix.

6. The method of claim 4, wherein the method further comprises removing gas from the casting.

* * * * *